United States Patent [19]

Nelson

[11] Patent Number: 4,635,559

[45] Date of Patent: Jan. 13, 1987

[54] PIPELINE MONORAIL SYSTEM

[76] Inventor: Warren B. Nelson, 3410 Montvue Dr., Meridian, Id. 83642

[21] Appl. No.: 586,308

[22] Filed: Mar. 5, 1984

[51] Int. Cl.[4] ..... B61B 13/06; B66F 11/04

[52] U.S. Cl. ..... 104/119; 104/120; 104/124; 105/144; 105/145; 414/747

[58] Field of Search ..... 104/118, 119, 120, 124, 104/3, 107; 105/141, 144, 145, 146, 147, 154, 29 R, 30; 414/747

[56] References Cited

U.S. PATENT DOCUMENTS

| | | | |
|---|---|---|---|
| 3,012,521 | 12/1961 | Lizh | 105/145 |
| 3,518,947 | 7/1970 | Borst | 105/154 X |
| 3,776,141 | 12/1973 | Gelhard et al. | 104/123 |
| 4,217,727 | 8/1980 | Fetty et al. | 105/145 |
| 4,232,610 | 11/1980 | Theurer | 104/3 |
| 4,236,454 | 12/1980 | Erickson et al. | 104/120 X |
| 4,241,664 | 12/1980 | Cable | 105/141 X |
| 4,243,147 | 1/1981 | Twitchell et al. | 104/172 R X |
| 4,260,869 | 4/1981 | Slavens et al. | 104/119 X |

*Primary Examiner*—Robert B. Reeves

*Assistant Examiner*—Glenn B. Foster

*Attorney, Agent, or Firm*—Paul F. Horton

[57] ABSTRACT

A pipeline monorail comprising a pipeline provided with at least one outwardly extending flange extending the length of the pipeline; two carriages, longitudinally spaced on the pipeline, each carriage having wheels operable to frictionally engage the flange of the pipeline for guidance, the wheels of at least one of the carriages being driven by a power source for propelling the carriages which carry and are connected by a load carrier, preferably including a boom. The boom is adapted to carry pipe sections and is longitudinally moveable relative to the carriages for suspending the pipe sections forwardly of the existing end of the pipeline and is operable to lower or raise the pipe section for attachment to the existing pipeline for construction of the pipeline. Each section so attached is also provided with a flange. Pedestals are used to support the pipeline where required. In this manner, a complete pipeline can be installed with a minimum of environmental damage and without the usual necessity of roads, return lines, and the like.

17 Claims, 9 Drawing Figures

PIPELINE MONORAIL SYSTEM

BACKGROUND OF THE INVENTION

1. Field of the Invention

This invention relates, in general, to conveyor systems and, in particular to pipeline monorail systems for use in the construction and maintenance of pipelines.

2. Description of the Prior Art

It is highly desirable in the construction and maintenance of a pipeline that minimal damage be done to the environment. Cost efficiency is also a major consideration. In conventional pipeline construction an access road is required and clearing of trees, burning or hauling of the debris, leveling, grading, and hauling of soil and gravel results. Additionally, for maintenance of the pipeline a degree of maintenance of the roads is also required. The swath of vegetation destroyed as well as the road and the pipeline, itself, may be destructive to the fauna and flora of the area and a significant unwanted impact on the environment of the region results.

While there are no known inventions directed to this particular problem of pipeline construction, several relevant inventions relate to using a pipeline for machinery and equipment conveyance.

U.S. Pat. No. 4,175,224 issued to E. F. Sims discloses apparatus for transporting heavy equipment on a pipeline. Sims utilizes pneumatic tires for traction on a smooth surfaced pipeline and steerable wheels for guidance. Sensors are used for controlling the steering. U.S. Pat. Nos. 3,861,319 and 3,776,141 issued to Gelhard et al show a transportation system for hostile environments. Gelhard et al utilizes two conduits vertically connected, each conduit having a trackway within and having rails for a suspension train on the outside. U.S. Pat. No. 3,575,274 issued to S. E. Ewing discloses an inspection vehicle for a conveyor belt.

SUMMARY OF THE INVENTION

The present invention comprises, generally, a pipeline monorail system having a pipeline with one or more radially extending flanges extending substantially the full length of the pipeline; a pair of carriages utilizing the flange for guidance, for propulsion, and in some cases, for support; a power source; and a load carrier including a boom operable to carry and vertically raise or lower a pipe section to be added in the construction of the pipeline. The flange or flanges of the pipeline preferably include or consist of a roller chain engagable by drive sprockets of the carriage for positive traction. The carriage, in the preferred embodiment, includes wheels engaging opposing bottom sides of the pipeline for stabilization. Additionally, a portion of the load carrier may be used for carrying cargo or personnel. A more comprehensive definition of the system may be found in the appended claims.

It is therefore a primary object of the present invention to provide a pipeline monorail system having a pair of carriages operable to carry a boom which, in turn, is operable to carry a pipeline section and to raise or lower the pipeline section for addition to the pipeline during construction with minimum effect on the ecology of the area.

It is also an important object of the present invention to provide a pipeline including at least one radially and outwardly extending flange for engagement by drive and guidance wheels of the carriages.

These and many additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
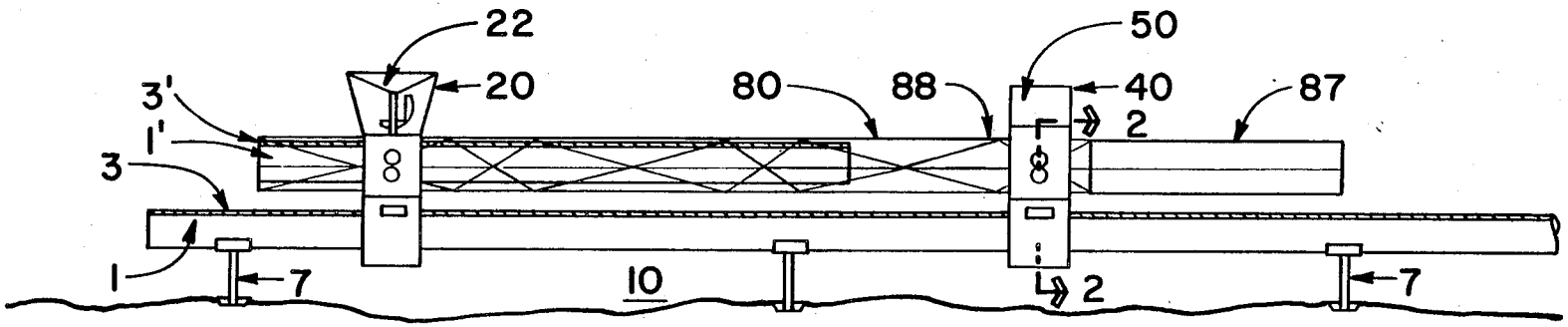
FIG. 1 is a schematic view of a preferred embodiment of the pipeline monorail system of the present invention.

Referring now to the drawings, and more particularly, to FIG. 1, an embodiment to be preferred of a pipeline monorail system 10, made according to the present invention is disclosed. Pipeline monorail system 10 includes a pipeline 1, means for supporting the pipeline designated generally by the numeral 7, at least two carriages designated by the numerals 20 and 40 respectively, a load carrier 80, and power source means 50, preferably carried by one of the carriages 40.

Figure 2:
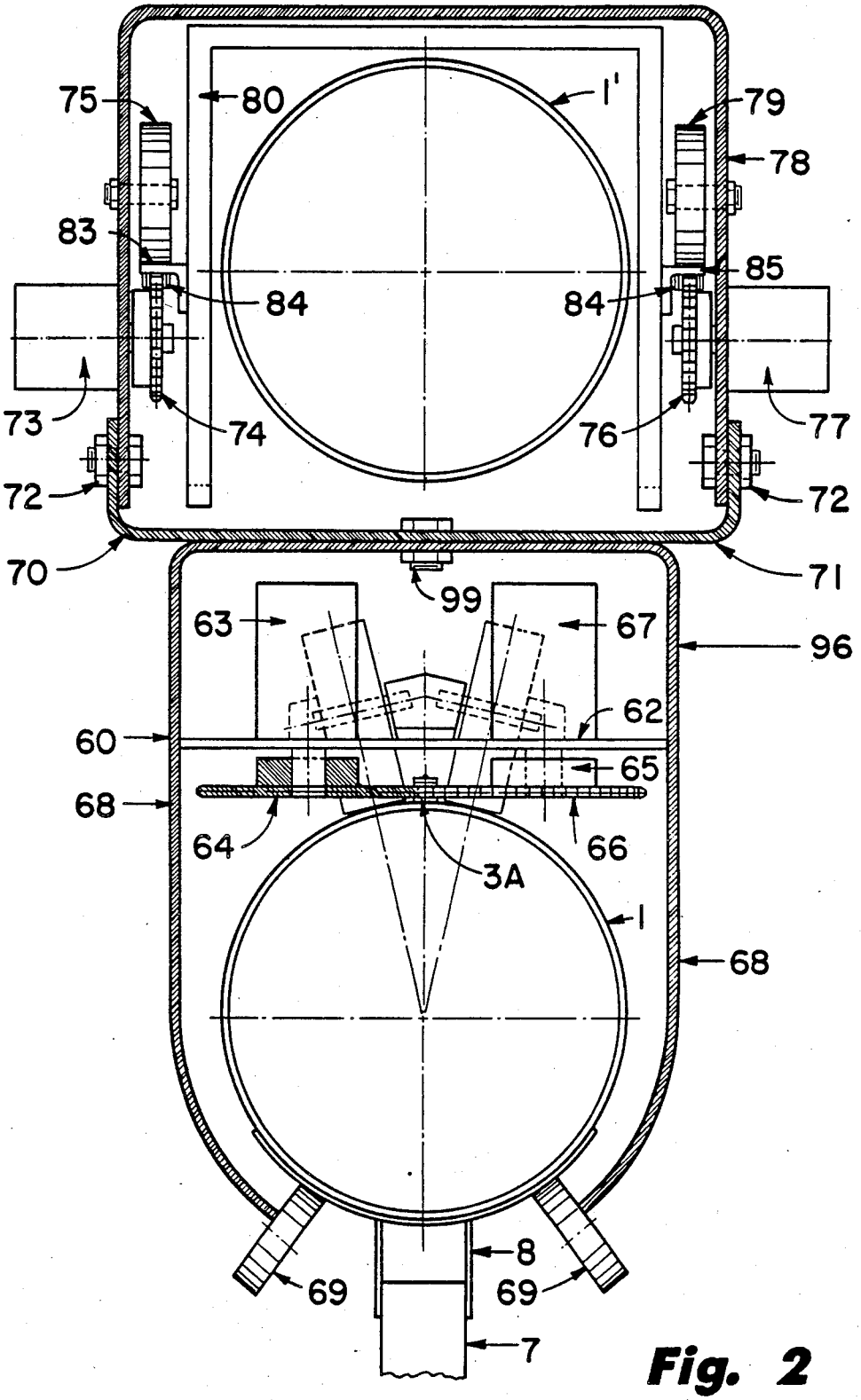
FIG. 2 is a section view of a power driven carriage of the present invention taken along lines 2—2 of FIG. 1

In the first preferred embodiment of the invention, as shown to advantage in FIGS. 1 and 2 of the drawings, pipeline 1 includes a single flange 3, identified specifically as 3A in FIG. 2, vertically projecting from the outer surface of the pipeline, radial to the longitudinal axis of the pipeline section to which it is affixed. The flange extends along the pipeline for its entire length.

The pipeline may be made of any suitable material and be of any suitable diameter, it only being necessary that the strength of the pipeline be sufficient to support the carriages under load. Conventional cylindrical steel pipe is contemplated for the carrying of water, oil, slurry, or the like.

Figure 9:
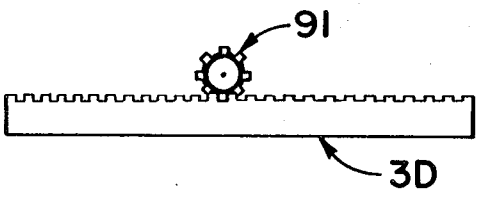
FIG. 9 is a partial plan view of a flange in the form of a rack, engagable by a drive pinion.
Figure 8:
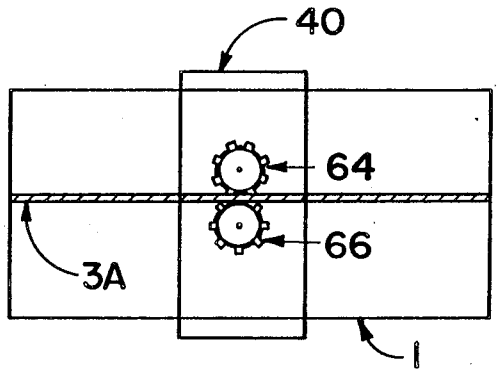
FIG. 8 is a partial plan view of the pipeline with a single, vertically extending flange consisting of a roller chain and a drive system utilizing drive sprockets.
Figure 7:
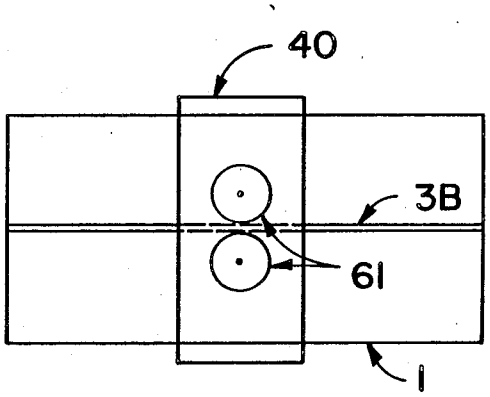
FIG. 7 is a partial plan view of the pipeline with a single, vertically extending flange and a drive system utilizing compression rollers.

Flange 3 of the first preferred embodiment consists of a roller chain 3A engaged by drive means, designated generally by the numeral 65, including horizontally disposed drive sprockets 64 and 66 operable to engage and mesh with the roller chain, also shown to advantage in FIG. 8. While flange 3 is preferably in the form of a roller chain, it is also contemplated that the flange may be constructed of a rail 3B, provided with opposing planar surfaces and engaged by compression rollers for drive, as shown in FIG. 7; or a rail 3D in the form of a rack engaged by a drive pinion, as shown in FIG. 9; or include a roller chain affixed to a rail, the chain being engaged by a drive sprocket, in a manner used elsewhere in the invention as will hereinafter be explained.

Figure 5:
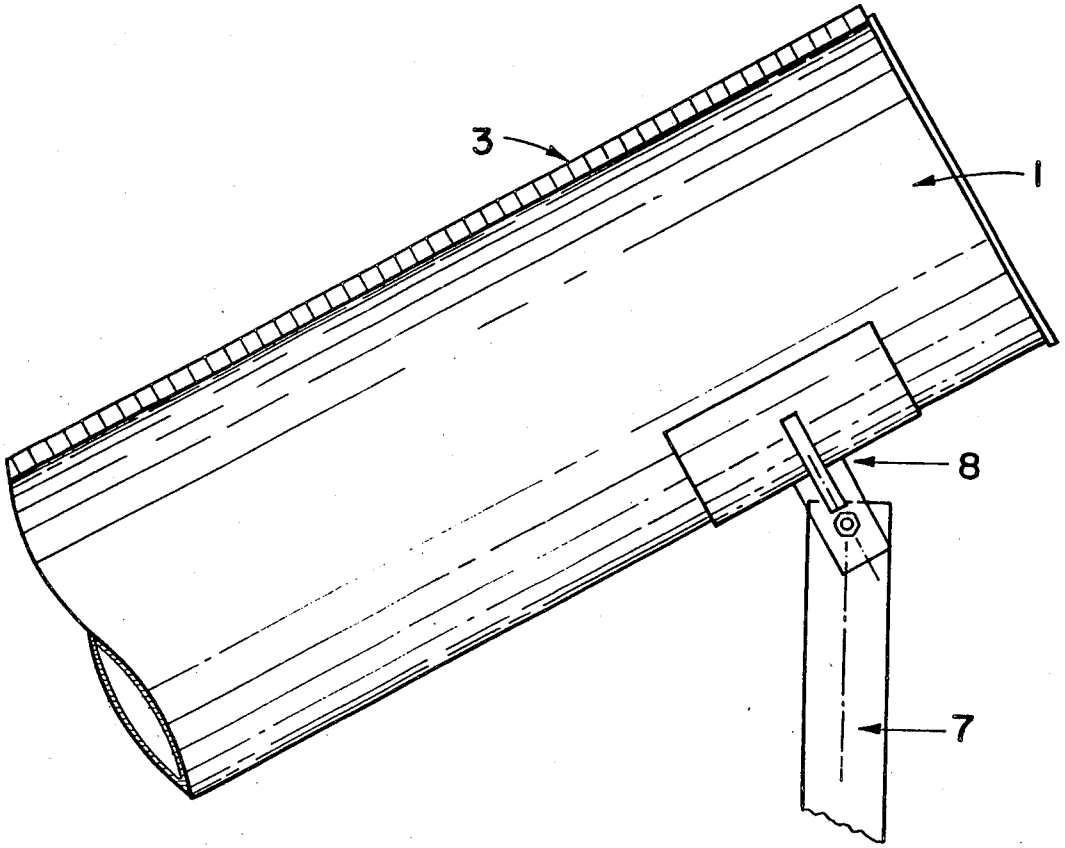
FIG. 5 shows attachment of the pipeline to a pedestal.

Pipeline support means, preferably in the form of pedestals 7, support the pipeline at various heights above ground level, depending upon the pipeline grade and the topography of the area involved. As shown in FIG. 5, pedestal 7 is connected to pipeline 1 by means of a holding bracket 8 pivotally fixed for a selected grade. Bracket 8 may be welded or otherwise attached to the pipeline.

Referring again to FIGS. 1 and 2, the carriages 20 and 40 of the present invention are shown. While more than two carriages may be used, it is contemplated that two carriages are all that is required. As will hereinafter be explained, it is essential that only one of the carriages be driven by a power source in that the carriages are connected by load carrier 80. The term "drive means", therefore, as used herein and in the appended claims is used in a broad sense and includes non-driven guidance rollers or sprockets and their engagement with one or more flanges 3.

One of the carriages, carriage 20, is provided with a cab 22 for the operator and for carriage controls, not shown. The other carriage, carriage 40, is provided with power source means, designated generally by the numeral 50, for providing all necessary power to the controls as well as the drive means. Power source 50 is preferably in the form of an engine-gasoline or diesel-but may be in the form of a motor driven by batteries or by electricity from an external source. In other respects, carriages 20 and 40 are substantially identical and therefore a description of one of the carriages, carriage 40, will suffice. Each carriage includes a lower chassis 60 and an upper chassis 70. Lower chassis 60 includes a housing 96, which may be constructed of steel tubing; drive means, designated generally by the numeral 65; and, to provide lateral stability to the carriage and for holding the carriage securely to the pipeline during travel, a pair of stabilizing wheels 69 supported by arms 68 depending from the housing framework 96. The stabilizing wheels are operable to engage pipeline 1 on the opposing bottom outer surfaces of the pipeline. Drive means 65 includes a pair of drive sprockets 64 and 66 operable to engage and mesh with the roller chains, flange 3A. As before explained, the drive means may include compression rollers, or drive pinions, depending upon the type of flange used. Drive sprockets 64 and 66 are driven by power source means 50, which provides all power to the carriages for propelling the carriages as well as power to operate other mechanical and electric devices which are or may be made a part of the system. In the preferred embodiment, a gasoline engine operating a hydraulic pump, both carried by carriage 40, is the power source. Two hydraulic motors 63 and 67, energized by the power supply, drive sprockets 64 and 66, respectively, for propelling the carriage. Carriage 20 is provided with an operator cab 22 with seat and controls and hydraulic hoses, not shown, extend between the carriages for conveying power for operation of the system.

Upper chassis 70 includes a lower frame member 71 connected to the top of frame 96 of the lower chassis by pivot bolt 99 permitting horizontal rotation of the upper chassis relative to the lower chassis. Pivotally connected by pivot bolts 72 to lower frame member 71 is an inverted U-shaped top member support frame 78 supporting a pair of hydraulic drive motors 73 and 77 provided with drive sprockets 74 and 76, respectively. Support member 78 also carries a pair of idler wheels 75 and 79 rotatably engagable with the top surface of side rails 83 and 85 of load carrier 80 for longitudinal movement of the load carrier relative to the framework of each carriage, as will hereinafter be explained. Motors 73 and 77 are energized by power source 50. It is necessary that only one of the carriages be provided with drive motors for extension of the load carrier.

Figure 3:
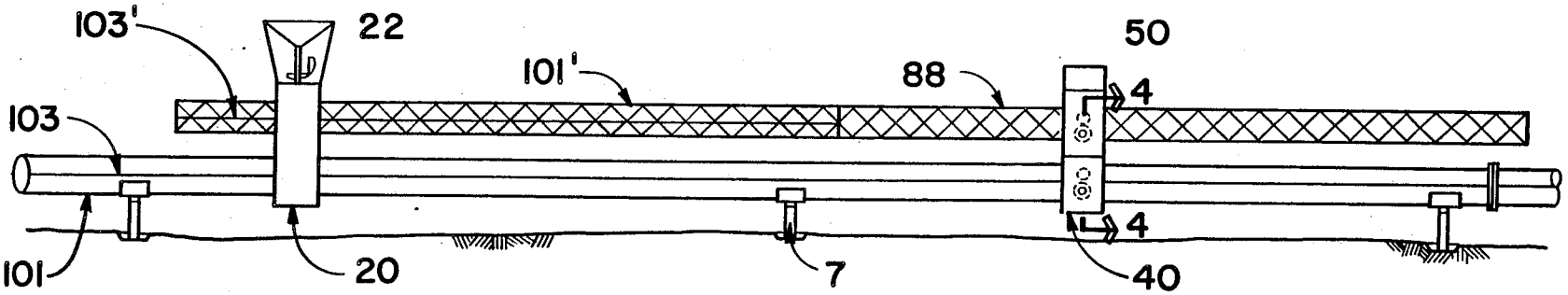
FIG. 3 is a schematic view of a second embodiment of the pipeline monorail system.
Figure 6:
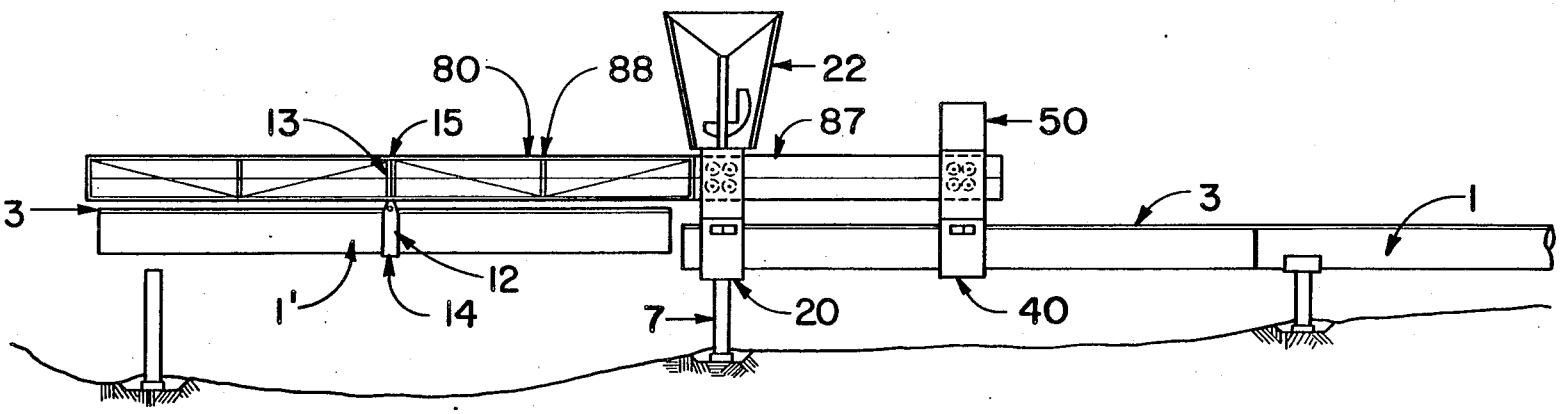
FIG. 6 is a schematic view of the system of FIG. 1 showing the placement of a pipe section to an existing pipeline during construction.

Load carrier 80 may be in the form of a boom 88 for carrying pipe sections, as shown in FIG. 3; may be a cargo and personnel carrier; or may, as preferred, include a boom 88 and a cargo carrier 87 as shown in FIGS. 1 and 6. Cargo-personnel carrier 87, referred to as the cargo carrier hereinafter, may be detachable from the boom for use alone with the carriages for maintenance or inspection purposes. Likewise, the boom may be used alone for pipeline construction, if so desired. Pipeline monorail system 10 also includes load carrier extension means for longitudinal movement of the load carrier 80 relative to one or more of the carriages. The extension means include a pair of horizontally projecting side rails 83 and 85 disposed on opposing lateral sides of the carrier and longitudinally extending the substantial length of the carrier and carrier drive means in the form of drive sprockets 74 and 76 rotatingly engaging the side rails. As with the flange or flanges 3 of the pipeline system, the side rails may have planar opposing surfaces; may include or consist of roller chains 84 as is preferred and shown to advantage in FIG. 2, or it may be in the form of a rack. Similarly, appropriate drive means such as compression rollers, drive sprockets or drive pinions may be employed depending upon the type of flange or flanges used. Drive sprockets 74 and 76 when driven by hydraulic motors 73 and 77, respectively cause longitudinal displacement of the load carrier relative to one or more of the carriages as determined by the operator.

Boom 88 has, as its primary function, a carrying capacity for pipeline sections 1' and, for this reason has an inverted U-shaped construction, as shown in FIG. 2. The pipeline section is suspended from boom 88 by suspension means, designated generally by the numeral 12, as shown in FIG. 6, for raising or lowering the pipeline relative to the supporting boom. Suspension means 12 may include one or more cradles 14, depending by means of a rope or cable 13 from a winch 15, powered by power source means 50. The winch is controlled by the operator from cab 22 of carriage 20. Cargo carrier 87, as shown in FIGS. 1 and 6, is U-shaped in cross section and is provided with a floor, two side walls, and two end walls to provide an open top receptacle for carrying cargo or personnel. The cargo carry is detachably connected to boom 88 by conventional connectors, not shown.

Figure 4:
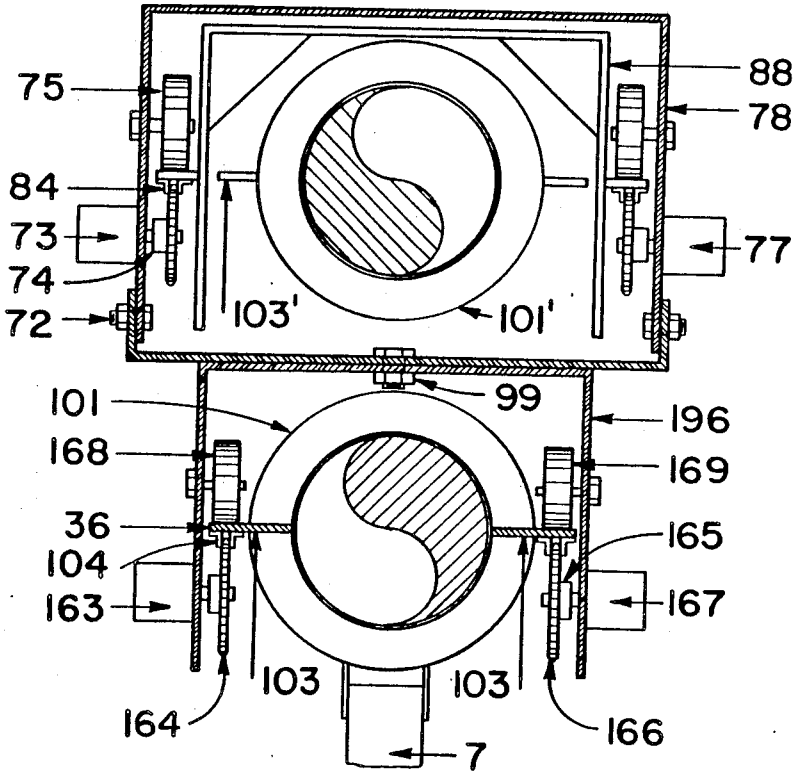
FIG. 4 is a sectional view of one carriage taken along lines 4—4 of FIG. 3.

Referring now to FIGS. 3 and 4, a second preferred embodiment of the present invention is disclosed. The pipeline monorail system shown in FIGS. 3 and 4, differs from the first embodiment shown only in the pipeline itself and the drive means of the lower chassis of each carriage. Pipeline 101 is provided with a pair of oppositely disposed, horizontally projecting flanges 103 extending radially from the longitudinal axis of the pipeline for the length of the pipeline. Each of the flanges include a roller chain 104 affixed to the undersurface of the flange, running the length of the flange. Drive means 165 including drive sprockets 164 and 166 rotatingly mesh with the rollers of the chain and may be powered by hydraulic motors 163 and 167 respectively. Support wheels 168 and 169, rotatably mounted to lower frame 196, ride upon planar upper surfaces of flanges 103 to support the carriage. It is obvious that flanges 103 may have planar opposing surfaces engagable by compression rollers or may be of other shape engagable by other drive means, as before stated.

In construction of a pipeline, and utilizing the first embodiment of the invention as shown in FIG. 6, one or more sections of the pipeline are first mounted to a pedestal 7 at a selected grade and fixed in place to begin the pipeline. Carriages 20 and 40 are then placed upon the pipeline with drive sprockets 64 and 66 of each carriage engaging roller chain 3A and with stabilizing wheels 69 engaging the underside of the pipeline. The drive sprockets of at least one of the carriages are driven by hydraulic motors 63 and 67 which obtain their power from the gasoline engine, power source 50.

A pipe section 1' is then loaded into boom 88 of load carrier 80 with cradle 12 supporting the pipe section. Winch 15 is used to draw the pipe section within the inverted U-shaped confines of the boom. Winch 15 may be supported directly by the boom or may be placed within cargo carrier 87 to raise the pipe section by means of a pulley system, not shown. The operator, sitting in cab 22 of carriage 20 then, by controls contained within the cab, causes the drive motors to be energized to propel the carriages, connected by load carrier 80 to the end of the pipeline, as shown in FIG. 6. The operator then energizes drive motors 73 and 77 of the upper chassis 70 of one or both carriages to extend the boom out over the end portion of pipeline 1. Winch 15 is then energized to lower the pipe section 1' into place for welding to the existing pipeline and perhaps for placement on the next pedestal. The empty cradle is then retracted by the winch and the carriage propelled in the opposite direction to reload with another pipe section and the process is repeated until the pipeline is completed.

For maintenance, the boom is simply detached from cargo carrier 87 and the cargo carrier is held in position between the carriages as the carriages are propelled along the pipeline. It is to be noted that where adjacent pipe sections are placed at different grades or where curved pipeline is employed, upper frame 78 of upper chassis 70 of each carriage pivot upon pivot bolts 72 and 99 to allow the carriages to travel unimpaired and without structural damage to the system. It is also to be noted that to carry the pipe sections through troughs in the pipeline, each carriage may be moved adjacent the ends of the load carrier and to carry the pipe sections over peaks in the pipeline, the carriages may be moved to a position of close apposition adjacent the middle of the load carrier.

Having thus described in detail the preferred selection of embodiments of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. A pipeline monorail system comprising:

a cylindrical pipeline provided with at least one outwardly and radially projecting flange longitudinally extending the length of said pipeline;

means for supporting said pipeline;

at least two carriages supportable by said pipeline, each of said carriages individually supported by said pipeline in front to rear relationship relative to another carriage, and each carriage longitudinally movable a selected distance along said pipeline relative to another carriage, each of said carriages including an upper and lower chassis, said lower chassis of each provided with drive means for engaging one or more flanges of said pipeline for guidance on said pipeline, and said upper chassis provided with a load carrier support frame;

a load carrier carried by and between each of said support frames of said carriages;

pivot means for pivoting said load carrier both horizontally and vertically relative to the lower chassis of each of said carriages whereby said carriages may move at varying vertical angles relative to one another over rises and through troughs and at varying horizontal angles relative to one another around curves; and power source means for providing power to said drive means of at least one of said carriages for propelling the carriage.

2. The apparatus as described in claim 1 wherein said pipeline is provided with a single, vertically projecting, flange having substantially planar opposing surfaces and wherein said drive means of at least one of said carriages is provided with compression drive rollers operable to engage said flange for propelling the carriage.

3. The apparatus as described in claim 1 wherein said pipeline on its upper surface is provided with a single, substantially vertical, projecting flange including a rack and wherein said drive means of at least one of said carriages is provided with a pinion drive gear operable to engage said rack for propelling said carriage.

4. The apparatus as described in claim 1 wherein said pipeline on its upper surface is provided with a single, substantially vertical, projecting flange including a roller chain extending the length of said pipeline and wherein said drive means of at least one of said carriages is provided with a drive sprocket operable to engage said chain for propelling said carriage.

5. The apparatus as described in claim 1 wherein said pipeline is provided with a pair of horizontally extending flanges, disposed on opposing sides of said pipeline, and wherein said drive means of at least one of said carriages is provided with compression rollers adapted to engage said flanges for propelling said carriage.

6. The apparatus as described in claim 1 wherein said pipeline is provided with a pair of horizontally extending flanges, disposed on opposing sides of said pipeline, at least one of said flanges provided with a horizontally disposed roller chain extending the length of said pipeline, and wherein said drive means of at least one of said carriages is provided with a drive sprocket adapted to engage said roller chain for propelling said carriage.

7. The apparatus as described in claim 1 further comprising load carrier extension means for longitudinal movement of said carrier relative to the support frames of each of said carriages.

8. The apparatus as described in claim 1 wherein said load carrier is provided with a boom for suspending a pipe section therefrom.

9. The apparatus as described in claim 1 wherein said load carrier is provided with a cargo carrier.

10. The apparatus as described in claim 1 wherein said lower chassis of each carriage is provided with a pair of stabilizing wheels operable to engage opposing sides of said pipeline for holding each of said carriages to said pipeline.

11. A pipeline monorail system comprising:

a pipeline provided with at least one outwardly projecting flange extending the length of the pipeline;

at least two carriages supportable by said pipeline, each of said carriages individually supported by said pipeline in front to rear relationship relative to another carriage and each carriage longitudinally movable a selected distance along said pipeline relative to another carriage, each of said carriages provided with drive means rotatingly and frictionally engaging each of said flanges for guidance of said carriages therewith, and each of said carriages provided with a pair of oppositely disposed stabilizing wheels engaging opposing sides of said pipeline for holding said carriages to said pipeline;

power source means connected to and operable to energize the drive means of one of said carriages for propelling said carriage; and a load carrier carried by and between each of said carriages, said load carrier being horizontally and vertically pivotal relative to each of said carriages, and said carrier provided with extension means for longitudinal movement relative to said carriage and said carrier provided with a boom for carrying pipeline sections, said boom provided with suspension means for raising or lowering pipeline sections for alignment and placement on or removal from an existing pipeline supporting said carriages.

12. The apparatus as described in claim 11 wherein the pipeline on its upper surface is provided with a single flange, and wherein said flange consists of a roller chain and wherein said drive means of at least one of said carriages includes a pair of drive sprockets engagable with said chain on opposing sides thereof, said drive sprockets being energized by said power source means for propelling said carriage along the pipeline.

13. The apparatus as described in claim 11 wherein said extension means of said carrier includes a pair of horizontally projecting side rails disposed on opposing lateral sides of said carrier, said rails longitudinally extending the substantial length of said carrier and carrier drive means secured to each of said carriages, said drive means rotatably engaging each of said rails for longitudinal displacement of said load carrier relative to a selected carriage.

14. The apparatus as described in claim 11 wherein said load carrier includes a boom, substantially inverted U-shaped in cross section and a rear cargo carrying section and wherein said carriages each include an upper housing, said load carrier contained in and supported by the upper housing of each carriage, said boom including a pipeline section suspension means for holding, raising, or lowering pipeline sections carried by said boom for installation thereof on an existing pipeline.

15. A pipeline monorail system comprising:

a pipeline provided with at least one radially and outwardly projecting flange longitudinally extending the length of the pipeline;

two carriages supported by said pipeline, each of said carriages individually supported by said pipeline in front to rear relationship relative to another carriage and each carriage longitudinally movable a selected distance along said pipeline relative to another carriage, each of said carriages provided with an upper chassis and a lower chassis, said upper chassis of each carriage provided with drive means operable to rotatably engage each of said flanges of said pipeline and;

power source means operable to energize said drive means of at least one of said carriages for propelling said carriage along the pipeline; and a load carrier carried by and between the upper chassis of each of said carriages, said carrier being horizontally and vertically pivotal relative to each of said carriages, said carrier adapted for longitudinal movement relative to said carriages, and said carrier including a boom having pipeline section suspension means for holding, raising, or lowering a pipeline section relative to said boom.

16. The apparatus as described in claim 15 wherein the pipeline includes a single flange and wherein said flange comprises a roller chain and wherein the drive means of one of said carriages includes at least one power driven drive sprocket for propelling said carriage.

17. The apparatus as described in claim 15 wherein said pipeline includes a pair of oppositely disposed horizontally extending flanges, each flange including a horizontally affixed roller chain extending the length of said pipeline and wherein the drive means of at least one of said carriages includes at least one power driven drive sprocket engagable with one of said roller chains for propelling said carriage.

* * * * *